US009103127B1

(12) United States Patent
Wade et al.

(10) Patent No.: US 9,103,127 B1
(45) Date of Patent: Aug. 11, 2015

(54) SYSTEM FOR INSTALLING CORNER TRIM WITH A HIDDEN FASTENER

(71) Applicant: Ply Gem Industries, Inc., Cary, NC (US)

(72) Inventors: John M. Wade, Pleasant Hills, MO (US); T. Daniel Hawk, Smithville, MO (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 14/162,381

(22) Filed: Jan. 23, 2014

(51) Int. Cl.
*E04F 13/073* (2006.01)
*E04F 19/02* (2006.01)
*E04F 13/06* (2006.01)

(52) U.S. Cl.
CPC ..... *E04F 13/0733* (2013.01); *E04F 19/024* (2013.01); *E04F 2013/063* (2013.01)

(58) Field of Classification Search
CPC . E04F 2013/063; E04F 19/022; E04F 19/024; E04F 13/0864
USPC ..... 52/287.1, 288.1, 302.1, 302.4, 302.6, 52/543, 546, 547, 551, 553
See application file for complete search history.

(56) References Cited

U.S. PATENT DOCUMENTS 1,521,938 A * 1/1925 Gartenberg ..... 52/282.1
2,293,744 A * 8/1942 Miles et al. ..... 52/547
2,993,306 A * 7/1961 Persons ..... 52/276
3,304,676 A * 2/1967 Sallie et al. ..... 52/276
3,500,600 A * 3/1970 Bagley, Sr. ..... 52/58
3,712,003 A * 1/1973 Hallock et al. ..... 52/254
4,104,839 A * 8/1978 Balzer et al. ..... 52/288.1
4,319,439 A * 3/1982 Gussow ..... 52/288.1
4,430,833 A * 2/1984 Balzer et al. ..... 52/255
4,706,426 A * 11/1987 Rumsey ..... 52/232
4,827,683 A * 5/1989 Poole ..... 52/316
4,999,961 A * 3/1991 McNary ..... 52/287.1
5,542,222 A * 8/1996 Wilson et al. ..... 52/287.1
5,974,748 A * 11/1999 Sciuga et al. ..... 52/287.1
6,041,555 A * 3/2000 Alpi ..... 52/11
6,219,980 B1 * 4/2001 Peck, Jr. ..... 52/288.1
6,311,442 B1 * 11/2001 Watanabe ..... 52/282.3
6,843,032 B2 * 1/2005 Hikai ..... 52/287.1
6,883,282 B1 * 4/2005 Newhart, III ..... 52/287.1
7,036,282 B1 * 5/2006 Keddell ..... 52/287.1
2003/0121217 A1 * 7/2003 Grizenko ..... 52/60
2004/0074175 A1 * 4/2004 Tierney ..... 52/255
2006/0059809 A1 * 3/2006 Smythe ..... 52/255
2006/0207197 A1 * 9/2006 Anderson ..... 52/211
2007/0094996 A1 * 5/2007 Young ..... 52/716.1
2008/0148672 A1 * 6/2008 Monteer ..... 52/533
2009/0038247 A1 * 2/2009 Taylor et al. ..... 52/287.1
2009/0056252 A1 * 3/2009 Taylor et al. ..... 52/287.1

(Continued)

OTHER PUBLICATIONS

CertainTeed, "Restoration Millwork," Jan. 2014, 24 pages.

*Primary Examiner* — James Ference
(74) *Attorney, Agent, or Firm* — Lathrop & Gage LLP

(57) ABSTRACT

A system for installing trim installations at external corners of a building. The trim serves both an aesthetic purpose in adding a decorative feature to building envelopes and also adds an additional weatherproofing purpose in allowing for more complete weatherproofing of building envelope corners and openings. The system relates to a concealed fastening building finishing element system that enables concealed fastening of finishing trim.

9 Claims, 2 Drawing Sheets

(56) References Cited * cited by examiner

U.S. PATENT DOCUMENTS

| | | | | |
|---|---|---|---|---|
| 2009/0235596 | A1* | 9/2009 | Tyler et al. | 52/287.1 |
| 2010/0088987 | A1* | 4/2010 | Monteer | 52/302.6 |

SYSTEM FOR INSTALLING CORNER TRIM WITH A HIDDEN FASTENER

RELATED APPLICATIONS

1. Technical Field

The present disclosure relates to a system for installing corner trim on a building or structure with a system of brackets that are hidden from view and that obviate the need for cleanup of fastener holes.

2. Background

In the conventional manner of applying corner trim to a building structure the installer has already completed the installation of paneling to the wall and brought the edges of the from the two sides of the corner as close to the corner as time and costs permit. The installer then cuts a first length of trim to be applied in a vertical orientation to the corner to obscure the first side of the corner. The installer then cuts a second piece of trim to length for abutting the first panel which approaches the corner from the opposite side of the building. The principle two principal reasons for securing corner trim to a building is to obscure the gap between the oppositely approaching siding panels and to prevent the intrusion of moisture to surfaces that can be degraded by exposure to moisture. An open gap between the abutting siding lengths may lead to water intrusion underneath the siding that could result in wood rot, mold growth and ultimately structural damage to the building. Moreover, should high speed wind apply back pressure to a siding length at the gap, the resulting pressure on the siding could tear the siding loose from the structure. Additionally, corner trim provides a much more attractive appearance than closely butted siding members and serves to enhance the aesthetic appeal of the structure.

In a typical application described above the installer secures the oppositely approaching boards to the building surface with screws or nails. It is the process of passing nails or screws through the boards into the building structure that depressions are created in the surface where the nails or screws have passed that either are preferably retouched with a water-proof filling compound to create a smooth surface. The filled surface is then painted to create an unblemished appearance. It will be appreciated that these additional steps are time consuming and add additional cost to the installation.

Unfortunately, and particularly in regions of the country where there are temperature extremes and/or high humidity, the hardened water proof filling compound over time is often expunged either partially or fully from the fill hole because of expansion and contraction of the siding panels due to temperature changes or the absorption of moisture that causes the siding boards to swell when damp and contract when ambient moisture recedes. This expungement of the putty creates an unsightly appearance that then requires additional costly maintenance to remedy.

Even when the highest skill level is used to secure the siding boards to the structure small gaps or uneven end cuts can result. This less than desirable outcome can efficiently and cost effectively be remedied with the application of the disclosed corner trim system.

An object of the present invention is to provide trim that can be attached to a building corner in a manner that does not require driving attachment hardware through the front face of the trim.

For the foregoing reasons, there is a need for a trim system utilizing a hidden bracket system that does not require the use of any exposed fasters to secure the trim to the building.

These and other advantages of the invention will be further understood and appreciated by those skilled in the art by reference to the following written specification, claims, and appended drawings. The contents of this summary section are provided only as a simplified introduction to the disclosure, and are not intended to be used to limit the scope of the appended claims.

SUMMARY

This disclosure relates to a concealed fastening building finishing element system that enables concealed fastening of corner trim to an underlying structure. The trim serves both an aesthetic purpose in adding a decorative feature to building envelopes and also adds an additional weatherproofing purpose in allowing for more complete weatherproofing of building envelope corners and openings.

In accordance with one aspect of the disclosure, there is provided a concealed corner trim system including trim members, each trim member having a structure-facing surface and an exterior-facing surface.

The invention advantageously allows the use of standard fastening guns and standard commercially available fasteners. This advantageously results in minimum cost of implementation and minimum additional skills required for installers.

Various objects, features, aspects and advantages of the inventive subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

DETAILED DESCRIPTION

Figure 1:
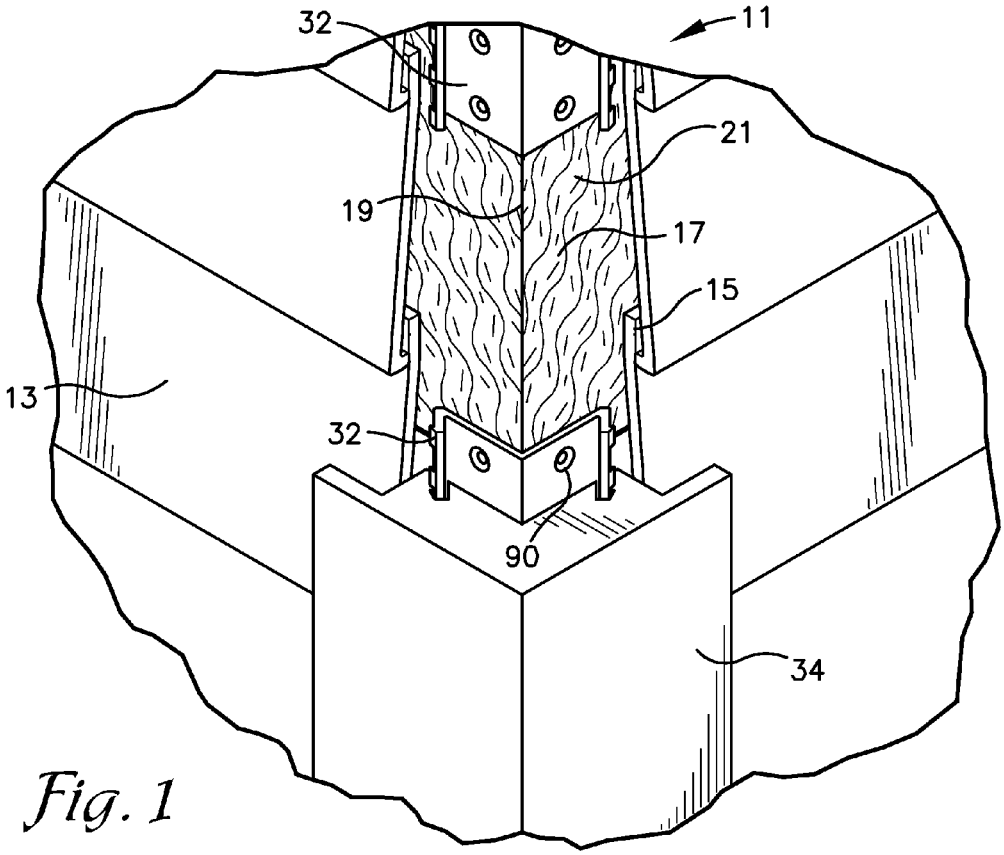
FIG. 1 illustrates an exemplary hidden bracket and a partially completed corner trim member installation in accordance with an exemplary embodiment.

Referring first to FIG. 1, which reveals a building corner 11, siding panels 13 with panel end edges 15 secured in position atop wall materials 17. The wall materials 17 come together at joint 19 forming the corner 11 of the building 21. The hidden bracket corner system 30 shown as partially installed, is comprised of a bracket 32 and trim pieces 34.

Figure 2:
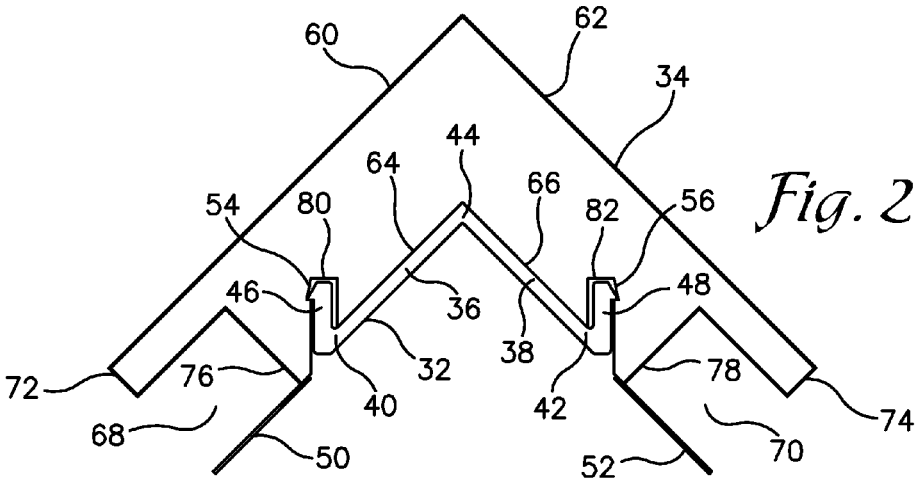
FIG. 2 illustrates a plan view of an exemplary embodiment of a bracket engaged with a trim member.

FIG. 2 reveals an exemplary first embodiment of the bracket and panel system. FIG. 2 illustrates a cross section, or plan view, of the trim piece 34 secured to the bracket 32. The bracket and trim are preferably fabricated from a durable and rigid engineered plastic, or resin; however, metal and ceramic brackets and trim are also contemplated. The bracket 32 is comprised of first and second orthogonally disposed panel elements 36, 38 each with an outboard end 40, 42. The panels are joined at centerline 44. At least one flange 46, 48 extends outwardly from each of the outboard ends 40, 42 of the first and second orthogonally disposed panel elements 36, 38. At least one locking tooth 54, 56 extends outwardly from each of the flanges 46, 48.

FIG. 2 also reveals, in cross section, the trim piece 34 that is attachable to the bracket 32. The trim 34 includes a first and second outer face surface 60, 62, a first and second hidden surface 64, 66 facing the building, and a cutout 68, 70 on each side of the trim piece proximate the first and second hidden surfaces. The cutouts 68, 70 are comprised of overhangs 72, 74 that serve to shield the potentially rough cut edges 15 of the siding panels 13 from view by an onlooker. The overhangs 72, 74 are preferably no thicker than 0.25 inches and extend no further than 0.75 inches from the cutout face surfaces 76, 78. FIG. 2 also reveals at least one longitudinally extending slot 80, 82 disposed within each of the first and second trim piece hidden face surfaces 64, 66 for receiving the at least one flange 46, 48 extending outwardly from the outboard ends 40, 42 of the first and second orthogonally disposed panel elements 36, 38. The flanges 46, 48 are preferably canted away the plane of the panel elements 36, 38 at an angle in the range of from 120 to 150 degrees and preferably at 135 degrees. The bracket 32 may optionally include a weather strip 50, 52 that extends outwardly from the hidden surfaces facing the structure 64, 66. The weather stripping 50, 52 serves to prevent the intrusion of moisture beneath the siding panels 13, or trim piece 34, and are flexible yet resilient. The weather stripping 50, 52 may optionally be secured to the trim 34 with an adhesive or formed as part of the fabrication of the trim and preferably extends a distance consistent with the overhangs 72, 74.

In operation, as best seen in FIG. 1, the first embodiment of the bracket 32 is positioned over the joint 19 of the building corner 11. The bracket 32 is then secured in position by passing screws or nails through the holes 90 in the orthogonally disposed panel elements 36, 38. Once an appropriate number of brackets 32 are in position atop the building corner 11 the trim piece or pieces 34 may be snapped into position. To accomplish securing the trim 34 to the bracket 32 the trim piece 34 is placed atop the bracket with the longitudinally extending slots 80, 82 of the trim piece aligned with the outwardly extending flanges 46, 48 of the bracket. Sufficient pressure must be applied to the surface of the trim to allow the flanges 46, 48 with their locking teeth 54, 56 to fully traverse to the top of the longitudinally extending slots 80, 82. Once the flanges 46, 48 are inserted into the slots 80, 82 to the desire depth, the trim pieces are secured in position and because the locking teeth will bite into the walls of the slots 80, 82 there will be limited opportunity to reposition the trim 34.

Figure 3:
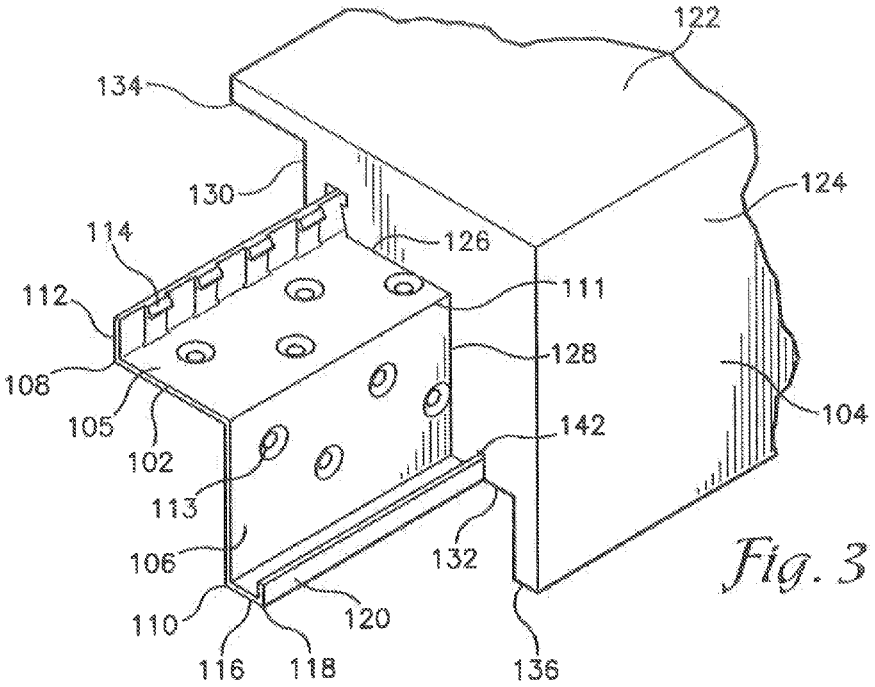
FIG. 3 illustrates an alternative embodiment of a bracket engaged with a trim member.
Figure 4:
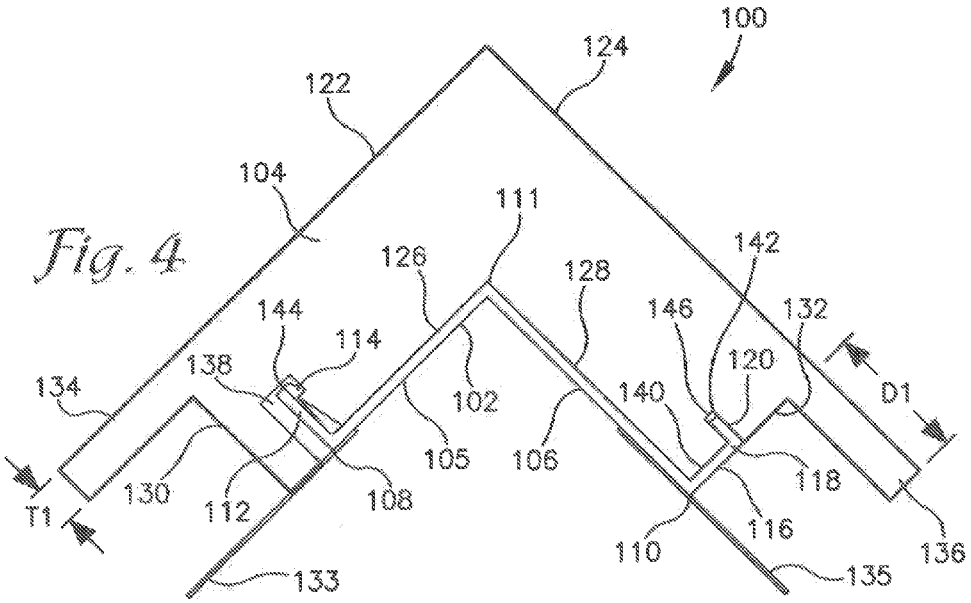
FIG. 4 illustrates a plan view of an alternative exemplary embodiment of a bracket engaged with a trim member.

An alternative embodiment of the bracket system 100 can be seen in FIGS. 3 and 4. The alternative embodiment 100 functions in the same way as the first embodiment with the bracket 102 being positioned over the corner of the building and the trim 104 being snapped into position atop the bracket. As best seen in FIG. 4, the bracket 102 is comprised of first and second orthogonally disposed panel elements 105, 106 each with an outboard end 108, 110 and joined at centerline 111. The panel elements 105, 106 also include at least one through hole 113 on each panel for passing through retaining hardware such as a nail or a screw. A first flange 112 extends outwardly from the first orthogonally disposed panel element 105 at the outboard end 108. The first flange 112 includes at least one locking tooth 114. The at least one locking tooth 114 may extend either inwardly or outwardly to accomplish the objective of locking the trim 104 to the bracket 102. The bracket 102 further comprises a second flange 116 with an outer end 118, such that the second flange 116 extends orthogonally outwardly from the second panel element 106. The second flange 116 further includes a minor flange 120 extending outwardly from the outer end 118 of the second flange.

The bracket system 100 further comprises at least one trim piece 104 that is attachable to the bracket 102. The trim 104 includes a first and second face surface 122, 124, a first and second hidden surface 126, 128 facing the building, and a first and second side face 130, 132 that will face the installed siding panels. The first side face 130 is overhung by the first face surface 122 and the second side face 132 is overhung by the second face surface 124. The overhangs 134, 136 are preferably no thicker than 0.25 inches, as shown at T1, and extend a distance no approximately 1.0 inch, as shown at D1, from the cutout face surfaces 130, 132. The bracket may optionally include weather strips 133, 135 that extend outwardly from the outboard ends 108, 110 of the panel elements 105, 106. The weather strips 133, 135 preferably extend about 1.0 inches or a distance consistent with the overhang length D1. The weather strips 133, 135 are flexible yet resilient and are positioned beneath the siding panels 13 to serve as a barrier to the entry of moisture beneath the panels or the trim 34.

The trim piece 104 further comprises at least one longitudinally extending slot 138 disposed within the first hidden surface 126 for receiving the first flange 112 and at least one locking tooth 114 that may extend either inwardly or outwardly. The trim piece 104 further includes an undercut 140 on the second side face 132 for receiving the second flange 116 of the bracket 102. The trim piece 104 also includes at least one longitudinally extending slot 142 disposed within the second side face 132 for receiving the minor flange 120 of the bracket 102.

In operation the alternative embodiment of the bracket 102 is secured to the corner of a building in the desired location by passing preferred attachment device hardware, such as nails or screws, through the holes 113 in the panel members 105, 106. Once the bracket 102 is secured in position against the corner of the structure, the slots 138, 142 of the trim piece 104 are aligned with the flanges 112, 120 of the bracket 102. Once the flanges and brackets are aligned the installer simply presses against the face 122, 124 of the trim 104 until the tops 144, 146 of the flanges 112, 120 interfere with the bottom of the slots 138, 142. Once the flanges 112, 120 have effectively bottomed-out in the slots 138, 142 the trim piece 104 is secured in position and because the locking teeth will bite into the walls of the slots 138, 140 there will be limited opportunity to reposition the trim 104.

While the preferred form of the present invention has been shown and described above, it should be apparent to those skilled in the art that the subject invention is not limited by the figures and that the scope of the invention includes modifications, variations and equivalents which fall within the scope of the attached claims. Moreover, it should be understood that the individual components of the invention include equivalent embodiments without departing from the spirit of this invention.

It will be understood that certain features and subcombinations are of utility and may be employed without reference to other features and subcombinations and are contemplated within the scope of the claims. Not all steps listed in the various figures need be carried out in the specific order described.

We claim:

1. A bracket system for securing trim to a corner of a building to obscure the edges of siding approaching from each side of the corner, the bracket system comprising:

(a) at least one bracket that is attachable to a wall, the bracket further comprising:

(i) joined together first and second orthogonally disposed panel elements each with an outboard end;

(ii) a first flange extending outwardly from the first orthogonally disposed panel element, the first flange including at least one outwardly extending locking tooth; and (iii) a second flange with an outward edge, the second flange extending outwardly from the second orthogonally disposed panel element, the second flange further including a minor flange extending outwardly from the outward edge of the second flange; and (b) at least one trim piece that is attachable to the bracket, the trim piece including a first and second face surface, a first and second hidden surface facing the building, and a first and second side face wherein the first side face is overhung by the first face surface and the second side face is overhung by the second face surface;

(i) at least one longitudinally extending sloped slot disposed within the first hidden surface for receiving the first flange and the outwardly extending locking tooth, wherein when at a bottom of the sloped slot the locking tooth locks into position atop a narrow ledge thereby unreleasably securing the trim in position;

(ii) an undercut on the second side face for receiving the second flange of the bracket; and (iii) at least one longitudinally extending slot disposed within the second side face for receiving the minor flange of the bracket.

2. The bracket system of claim 1, wherein the first flange extending outwardly from the first panel element is disposed at an angle of 90 degrees to a plane of the first panel element.

3. The bracket system of claim 1, wherein the first flange extending outwardly from the first end of the first orthogonally disposed panel element has an inner face and an outer face.

4. The bracket system of claim 3, wherein the first flange inner face faces the centerline and the flange outer face faces away from the centerline.

5. The bracket system of claim 4, wherein the at least one locking tooth extends outwardly from the outer face.

6. The bracket system of claim 5, wherein the at least one outwardly facing locking tooth is for engagement with an interior surface of the longitudinally extending slot disposed within the first hidden surface of the trim piece.

7. The bracket system of claim 1, wherein at least one through hole is disposed within each of the first and second orthogonally disposed panel elements for passing a bracket securing device into the building structure.

8. The bracket system of claim 1, wherein in operation the minor flange is first inserted into the at least one longitudinally extending slot disposed within the second side face and then the first flange with the at least one outwardly extending locking tooth is inserted into the at least one longitudinally extending slot disposed within the first hidden surface.

9. The bracket system of claim 1, wherein the at least one bracket and at least one trim piece are fabricated from an engineered plastic.

* * * * *